United States Patent [19]

Kirk, Jr.

[11] 4,079,553

[45] * Mar. 21, 1978

[54] BUILDING CONSTRUCTION MEMBER

[75] Inventor: James D. Kirk, Jr., Oak Brook, Ill.

[73] Assignee: James D. Kirk, Sr., River Forest, Ill.

[ * ] Notice: The portion of the term of this patent subsequent to Jan. 4, 1994, has been disclaimed.

[21] Appl. No.: 753,283

[22] Filed: Dec. 22, 1976

Related U.S. Application Data

[63] Continuation-in-part of Ser. No. 540,420, Jan. 13, 1975, Pat. No. 4,000,594.

[51] Int. Cl.[2] ..... E04B 2/00

[52] U.S. Cl. ..... 52/71; 52/241

[58] Field of Search ..... 52/71, 241, 238, 242, 52/359, 584

[56] References Cited

U.S. PATENT DOCUMENTS

| | | | |
|---|---|---|---|
| 2,921,464 | 1/1960 | Olsen | 52/359 |
| 3,252,258 | 5/1966 | Blickman et al. | 52/584 X |
| 3,702,047 | 11/1972 | Harcuba | 52/241 |
| 4,000,594 | 1/1977 | Kirk | 52/71 X |

*Primary Examiner*—J. Karl Bell

*Attorney, Agent, or Firm*—Thomas W. Speckman

[57] ABSTRACT

Building walls and ceilings, beam or column covers, hollow columns, column covers, soffits, ducts, duct covers and solid construction posts fabricated from V-grooved gypsum board construction members which are adhesively secured in the V-groove areas to form angular faces. Interior and exterior walls using such construction members in combination with panel clips provide structures which are readily disassembled and reusable while providing good sound and thermal insulation properties.

14 Claims, 15 Drawing Figures

BUILDING CONSTRUCTION MEMBER

CROSS REFERENCE TO RELATED APPLICATION

This application is a continuation-in-part of my pending U.S. patent application Ser. No. 540,420 filed Jan. 13, 1975, BUILDING CONSTRUCTION MEMBER, to issue as U.S. Pat. No. 4,000,594, Jan. 4, 1977.

Much of the current construction of buildings for industrial, commercial and residential purposes utilize gypsum board construction which has become commonly known as "dry wall" construction. Gypsum board construction has become especially desirable due to its fire resistant properties. Further, the provision of gypsum board with various finish surface laminations and in forms which have even higher fire resistance than the conventional gypsum board, have made gypsum boards popular, especially for interior partitions. In the past, such walls have been erected by attaching gypsum board to a framework of sheet metal studs and other framing members by use of mechanical fastening means such as sheet metal screws. In such construction, the joints and the heads of mechanical fastening means must be finished by taping and filling. The prior construction requires substantial manual labor in the erection of the wall framing, in the attachment of the gypsum boards and in the necessary touch up. Further, such partition walls cannot be disassembled without severe damage to the gypsum board which renders the wall system largely unsalvageable in the event that new erection of the wall is required.

My above identified parent application discloses a construction member and erection technique which generally simplifies the erection of gypsum board walls. Use of the construction member disclosed in my pending application renders construction utilizing such members moveable and reusable in new locations as well as materially reducing the erection time. The disclosure, including the drawings, of my allowed application Ser. No. 540,420, to issue as U.S. Pat. No. 4,000,594 on Jan. 4, 1977, is incorporated herein by reference.

The present invention utilizes the construction member of my co-pending application in embodiments of interior wall systems, exterior wall systems, perimeter panel systems, and provides solid columns, column covers, ducts, duct covers and soffits. The present invention also provides simplified and more readily moveable wall systems utilizing panel clips and carrier clips according to this invention.

Certain preferred embodiments of the invention are shown in the drawings wherein.

One of the advantages of the wall structure of my invention is the ease of erection and the capability to dismantle the walls and reassemble them using the same materials. Such flexibility is very desirable in modern commercial buildings which may be utilized for different purposes at different times but where a permanent appearing, fire resistant and soundproof or insulated structure is desired. The panel clip shown in FIGS. 1 through 3 aid in the ease of erection and in the mobility of the wall system. Panel clip 150 is used to hold the adjacent flanges of adjacent building construction members as described in my co-pending application.

Figure 1:
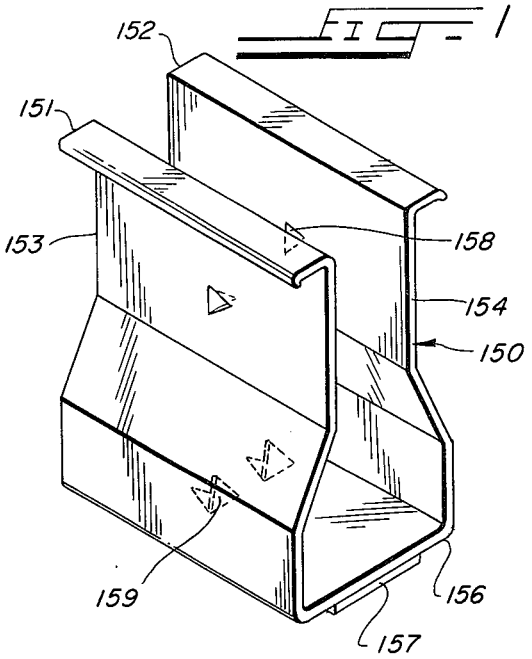
FIG. 1 is a perspective view of one embodiment of a panel clip according to this invention.

As best seen in FIG. 1, panel clip 150 comprises a generally U-shaped sheet metal or plastic shape having wall 156 which joins opposing legs 153 and 154 at one end. Legs 153 and 154 having outwardly extending flanges 151 and 152 at their other end. Legs 153 and 154 are separated by a distance so that spring action is obtained when clip 150 is in position holding the building construction member. Legs 153 and 154 may have indentations or barbs 158 to maintain clip 150 firmly in position. Wall 156 may have barbs 159 to impale the clip upon the building construction member flanges. It is preferred that panel clip 150 have means, such as the aforesaid barbs, to maintain the clip firmly in desired position during erection while fastened to only one building constructione member flange. The panel clips are desirably utilized every 2 to 4 feet in the wall construction of this invention. The panel clip may have resilient pad 157 attached to the outer portion of wall 156 to provide sound deadening to wall structures according to this invention.

Figure 2:
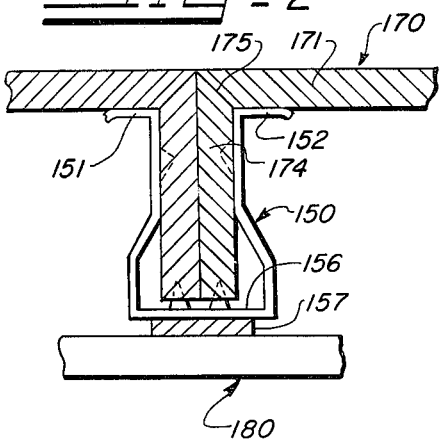
FIG. 2 is a cross-sectional view of one embodiment of wall construction according to this invention utilizing the clip shown in FIG. 1.

FIG. 2 shows the use of panel clip 150 in a typical wall construction as more fully described in my pending application. Building construction member 170 has central panel portion 171 and flange 174 extending from one face, adhesive means in V-groove joint 175 maintaining flange 174 in perpendicular relation to central panel portion 171. Panel 180 is the central panel portion of a similar building construction member enclosing the opposite side of the wall from building construction member 170. As seen in FIG. 2, clip 150 in addition to holding adjacent building construction members together by spring action against adjacent flanges, also acts as a spacer between the opposite panels of the wall. The action of clip 150 as a spacer results from flanges 151 and 152 being in the same planar relation and the distance from the plane through flanges 151 and 152 and the plane through wall 156 being substantially parallel and the same distance on all panel clips. Thus, the length of the flange 174 on building construction member 170 is not a critical feature and the end surface of the flange 174 is not important. Further, the fact that continuity between the opposing wall panels is eliminated except through resilient pad 157, which provides a superior sound barrier.

Figure 3:
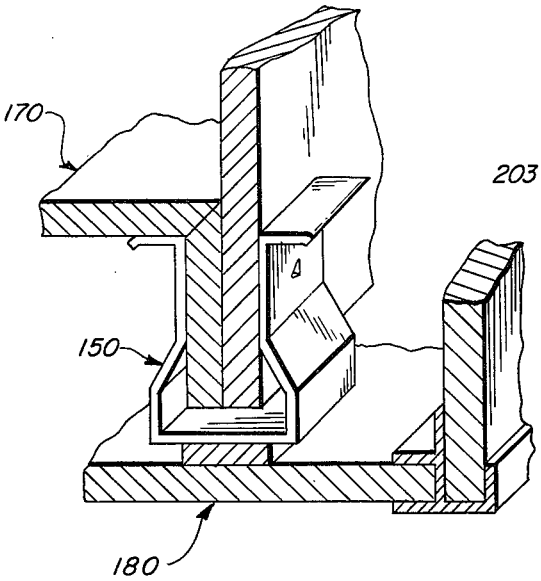
FIG. 3 is a cross-sectional perspective view of the corner detail of a wall system of one embodiment of this invention utilizing the panel clip shown in FIG. 1.

FIG. 3 illustrates utilization of clip 150 at an inside wall corner joint detail.

Figure 4:
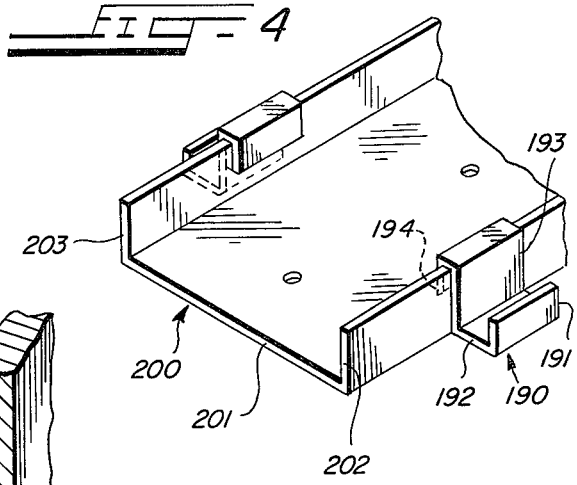
FIG. 4 is a perspective view of a bottom channel having carrier clips according to this invention for bottom or top support of the wall structure.

FIG. 4 shows the use of carrier clips 190 in one embodiment of the wall structure of this invention. Carrier clip 190 hangs on one of the upstanding legs 202 and 203 of floor channel 200 and carries the load of the building construction member of this invention without the necessity of mechanical fastening. Carrier clip 190 has inverted U-shaped portion with legs 193 and 194 to hold clip 190 snugly in position against channel leg 202. Clip 190 has U-shaped portion bounded by legs 191 and 193 of suitable width to snugly hold the thickness of the wall panels of the building construction member of this invention. The building wall panel assemblies are simply set into carrier clip 190 which hold them snugly at the bottom, the wall assembly being mechanically fastened or snap fastened at the top by an inverted U similar to that shown in FIG. 8 of my parent application. Such construction provides interior partitions which may be readily disassembled and reassembled in a different location utilizing the same materials, the only marks remaining being the holes necessary to secure floor channel 200 to the floor.

Figure 5:
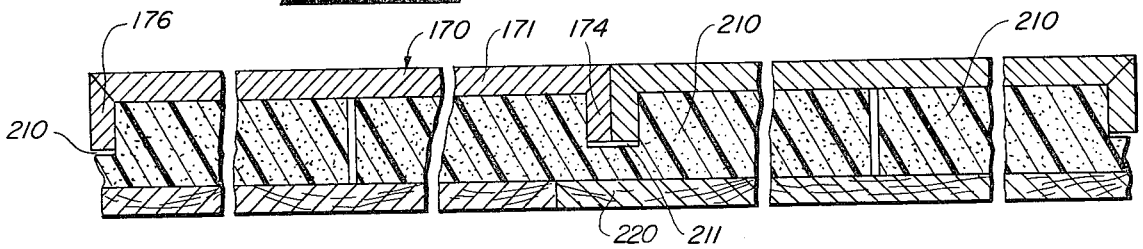
FIG. 5 is a cross-sectional view of an insulated wall structure of this invention suitable for interior or exterior use.

FIG. 5 shows the construction detail of a wall structure according to this invention which may be used in either interior or exterior construction. Building construction members as more fully described in my parent application are shown as building construction member 170 having central panel portion 171 and flanges 174 and 176 extending equally and perpendicularly in the same direction from one face thereof. The building construction members are assembled in juxtaposed planar array with flanges of adjacent members abutting each other as shown in FIG. 5. The core portion of the wall comprises rigid synthetic polymer foam slabs 210 having a central slot 211 for receiving flanges of adjacent building construction members. The other side of the building wall may be faced with any suitable surfacing material. Foam slabs 210 may be faced with a vinyl covering or any rigid panel may be fastened to the foam slabs, such as wood layer 220 shown in FIG. 5. Foam slab 210 may be adhesively fastened to building construction members 170 and wood sheets 220 may be adhesively fastened to foam slabs 210 thereby providing a rigid, composite and insulated wall structure.

Figure 6:
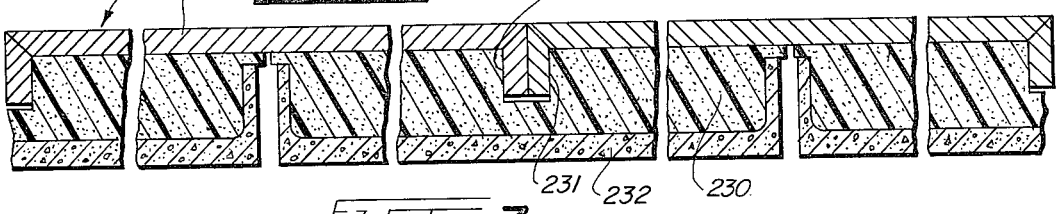
FIG. 6 is a cross-sectional view of an insulated wall structure of this invention suitable for interior or exterior use.

FIG. 6 shows another embodiment of a wall system according to this invention wherein building construction members 170 are assembled in the same fashion as previously described for FIG. 5 utilizing foam slabs 230 similar to foam slabs 210 and having slot 231 corresponding to slot 211 previously described. Foam slab 230 has precast concrete panel 232 affixed to its outer surface. The wall structure is assembled in the same fashion as described for the wall structure shown in FIG. 5 except that the outer wall layer of concrete is affixed to the foam slab and requires grouting between adjacent concrete joints at the edges.

Figure 7:
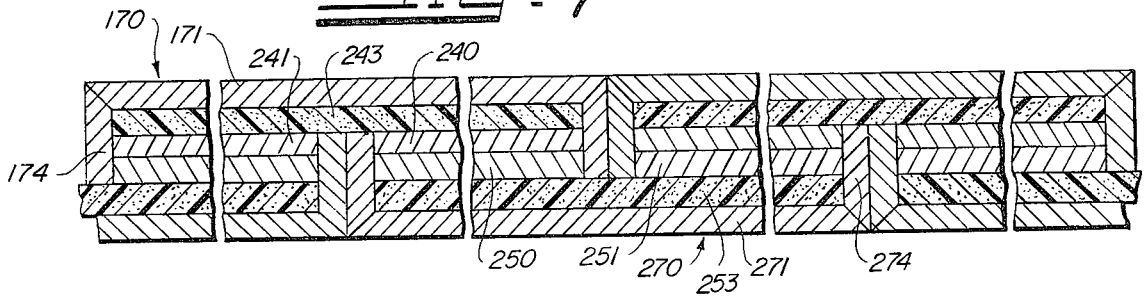
FIG. 7 is a cross-sectional view of an insulated wall structure of this invention suitable for interior or exterior use.

FIG. 7 shows yet another embodiment of a wall system of this invention using building construction members 170 and 270. In this embodiment the opposing building construction members are the same and have between their flanges synthetic polymeric foam having slots 242 and 252 for receiving adjacent flanges of the opposing building construction members. Opposing building construction members 170 and 270, together with the foam insulation attached may be readily adhered together to form a unitized construction by gluing the faces of foam board 240 and 250 together upon assembly as previously described. The embodiment shown in FIG. 7 is particularly well suited to the builder with minimum equipment at the job site since slots 242 and 252 can be formed by using two narrower pieces of foam.

Figure 8:
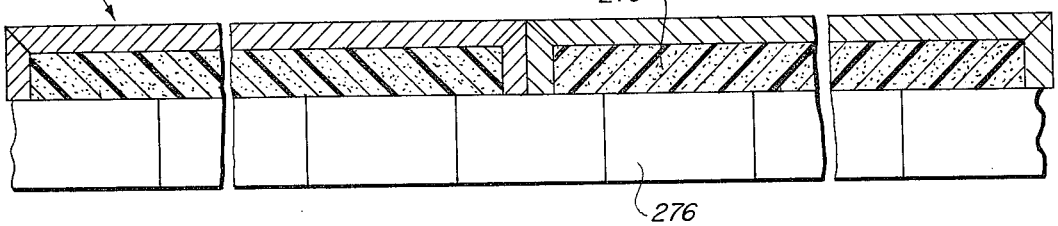
FIG. 8 is a cross-sectional view of a perimeter panel according to this invention for installation on the outside of a masonry wall.

FIG. 8 shows use of the building construction members 170 in an embodiment of this invention providing perimeter interior finishing of masonry walls. Building construction members 170 have synthetic polymeric foam sheet 275 filling the space between their flanges. The wall panel assembly made up of construction member 170 and foam 275 may be adhered to the masonry wall for permanent installation or may be securely mounted into channels at top and bottom for removeable installation.

Figure 9:
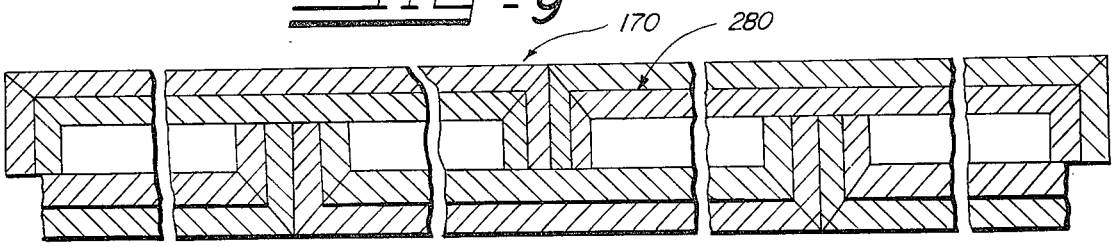
FIG. 9 is a cross-sectional view of a wall according to this invention utilizing multiple layers of gypsum board for greater fire resistance.

FIG. 9 shows a wall system according to this invention similar to that shown in FIG. 2 of my parent application except that building construction member 170 has a similar but smaller building construction member 280 adhesively mounted within the shallow channel of construction member 170 to provide a double thickness gypsum board wall on one or both sides of the wall system. The double thickness of the gypsum board provides enhanced fire protection and as is readily apparent may be used in the structures of my parent application as well as in the structures of FIGS. 5 through 8 described above. The double thickness gypsum board may be produced by adhering the flat pieces of gypsum board together and then V-grooving through the two pieces of gypsum board to the outer lamina or they may be produced by making construction member 170 separate from construction member 280 and then adhering them together.

The synthetic polymer foam for use in the structures of this invention may be substantially rigid organic polymer foam having good insulating properties and preferably a high temperature at which thermal decomposition occurs. Suitable foams include polystyrene, styrene-maleic anhydride, phenolic, such as phenol formaldehyde, polyurethane, vinyl, such as polyvinyl chloride and copolymers of polyvinyl chloride and polyvinyl acetate, epoxy, polyethylene, urea formaldehyde, acrylic, polyisocyanurate and the like. Preferred foams are selected from the group consisting of polystyrene and polyurethane. Particularly suitable foams are closed cell foams which provide high insulating properties and low permeability to moisture. Such organic polymer foams are substantially rigid bodies of foam and are well known in the art. In the structures of my parent application and those disclosed in FIGS. 5, 7, 8 and 9 of this application, it is apparent that the foam may be produced in place by well known foam-in-place techniques.

Any gypsum wallboard is suitable for use in this invention. Gypsum wall boards having fire resistant additives are suitable for use in this invention. Also, as described in my parent application, gypsum wallboards having any desired plastic or metallic coating are suitable. Gypsum lath boards are suitable for use in the structures of this invention and may be plastered over to provide a conventional plastered surface.

Panel clips as shown in FIG. 1, may be used in the structure of my parent application and in any of the wall systems shown in FIGS. 5 through 9. Likewise, the carrier clip 190 as shown in FIG. 4 may be used in the structures of my parent application and in any of the wall construction shown in FIGS. 5 through 9.

While the structures have been described with respect to walls, it is apparent the structures are suitable for use as ceilings.

Figure 10:
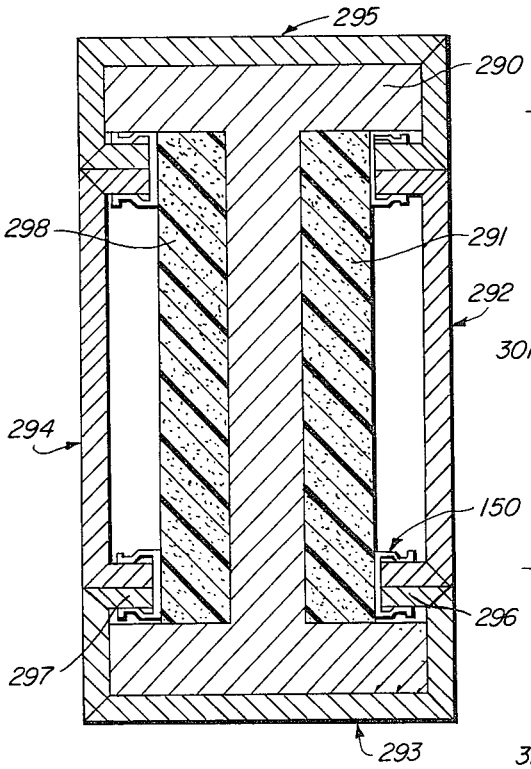
FIG. 10 is a cross-sectional view of one embodiment of a column or beam cover according to this invention.

FIG. 10 illustrates use of building construction members of this invention as beam covers, column covers and fireproofing assemblies. FIG. 10 shows I beam 290 encased in a fire resistant gypsum board protective covering. Construction members 292 and 294 are similar to building construction members 170 described earlier. End coverings 293 and 295 are similar to side coverings 292 and 294 with the addition of a second inwardly extending flange 296 and 297 formed in the same fashion utilizing the V-groove-glue adhesive technique previously described. The entire covering assembly may be held with panel clips 150 as shown. Side panels 292 and 294 may be completely prefabricated while the second flange on end panels 293 and 295 may be folded without gluing at the time of installation to provide easy installation around the beam. Additional fire protection to the web of the I beam may be afforded by gypsum boards 291 and 298 on each side of the I beam web which are securely held in place by the action of panel clips 150.

Figure 11:
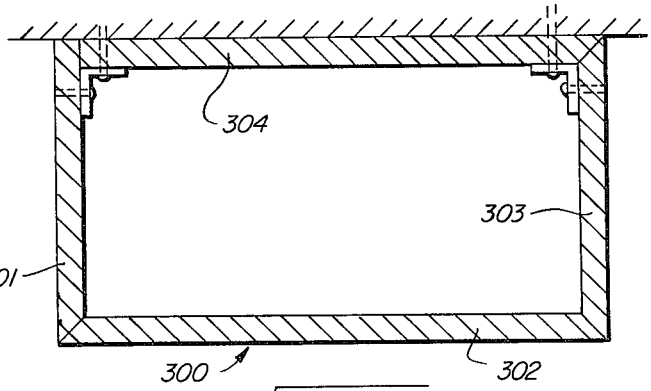
FIG. 11 is a cross-sectional view of a four-sided duct, column cover or hollow column or beam according to this invention.
Figure 11A:
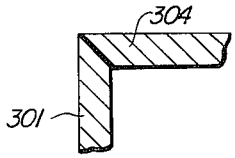
FIG. 11A is a cross-sectional view of another embodiment of the corner between sides 301 and 304 of the structure shown in FIG. 11.

Hollow columns, column covers, ducts and duct covers may be constructed using the principles of this invention as shown in FIG. 11. A four-sided structure which may be used as a duct, duct cover, hollow column or column cover is shown as 300 having sides 301, 302, 303 and 304 formed by the V-groove-adhesive technique of this invention utilizing conventional or high fire resistant gypsum board. FIG. 11A shows an embodiment of the corner junction between sides 301 and 304 of the structure shown in FIG. 11. The corner as shown in FIG. 11A is also formed by the same V-groove-adhesive technique.

Figure 12:
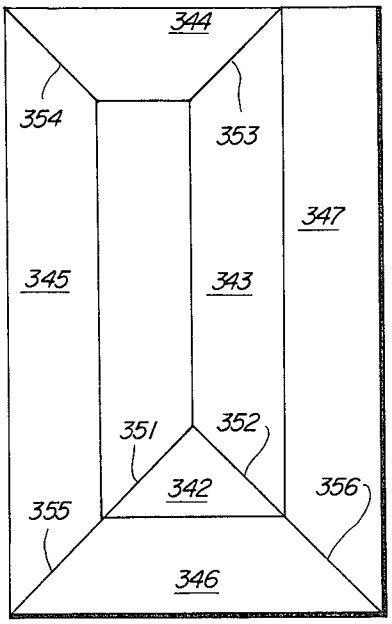
FIG. 12 is a cross-sectional view of a solid gypsum board column or beam according to this invention.

Solid columns may be provided from a flat sheet by using the principles of this invention as shown in FIG. 12. For example, a flat sheet of gypsum board starting with one edge portion 341 may be V-grooved and folded at right angles to form joint 351 and panel portion 342 which may be V-grooved to form joint 352 and panel portion 343 which may be V-grooved to form joint 353 and panel portion 344 which may be V-grooved to form joint 354 and panel portion 345 which may be V-grooved to form joint 355 and panel portion 346 which may be V-grooved to form joint 356 and other end panel portion 347. Of course, it is apparent that the process may be continued to form solid columns of any desired shape or size to meet specific load-bearing qualities. The solid columns or beams, such as illustrated by FIG. 12, may be utilized by use of the adhesive taught by my parent application to be suitable for the V-groove corners. Thus, both hollow and solid gypsum board structures may be provided according to this invention.

Figure 13:
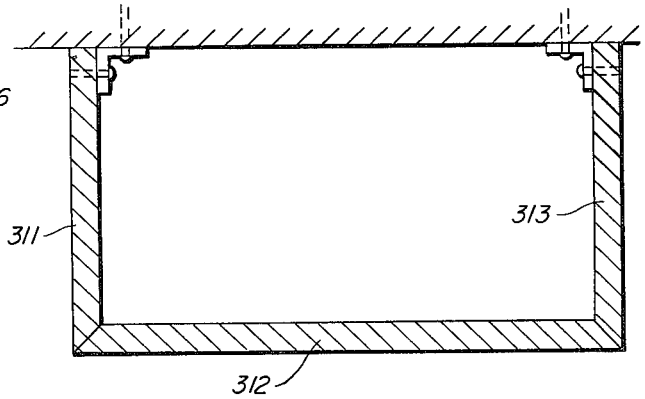
FIG. 13 is a cross-sectional view of a three-sided duct, duct cover, ceiling panel or soffit according to this invention.

FIG. 13 shows a three-sided duct, duct cover, soffit, beam cover or ceiling panel according to this invention which may be fabricated from gypsum board to provide a fire resistant structure. When used as ceiling panels, the structure as shown in FIG. 3 of my parent application may be used or the panel clips described above may be used.

Figure 14:
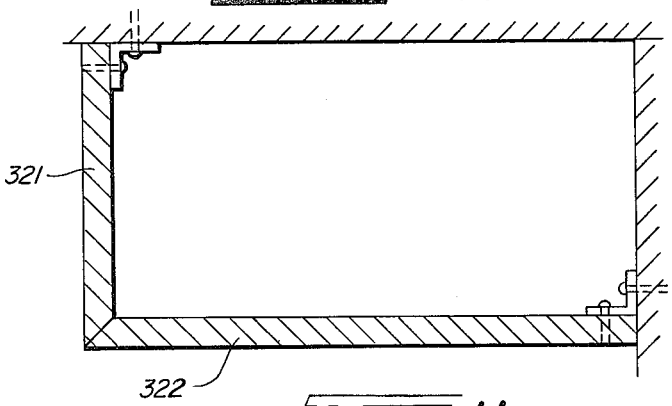
FIG. 14 is a cross-sectional view of a two-sided soffit, duct or duct cover according to this invention.

FIG. 14 shows a two-sided duct, duct cover, soffit or beam cover according to this invention which may be readily fabricated from gypsum board to provide a structure having desired finished facing and to provide fire resistant structures.

The V-groove-adhesive gypsum board structures of my invention may utilize any suitable adhesive which sets sufficiently rapidly for field assembly and which secures the cementious gypsum. A preferred adhesive is disclosed in my parent application. While the construction members may be fabricated at the construction site, it is obvious they may also be fabricated at a central facility.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

I claim:

1. A building wall or ceiling having one face comprising multiple juxtaposed building construction members which may be shipped to the job site in flat condition and formed at the job site into a wide, shallow, channel-shaped member with a central panel portion and having flanges extending equally and perpendicularly in the same direction from one face of the panel at opposite long edges thereof, comprising a rectangular panel of gypsum board having face laminae and a core layer of gypsum therebetween, said board having on one face thereof two V-grooves consisting of one V-groove set inwardly from each long edge for the full length of the gypsum board which penetrates the gypsum core substantially for the entire depth of said core leaving intact a sufficient thickness of the lamina of the face opposite the grooved face to act as a hinge, said grooves having adhesive means therein and defining between them a central panel portion with flanking flanges outwardly of said grooves when said flanges are hinged perpendicularly to said central panel portion and retained in that position by the adhesive means in said grooves, said flanges of adjacent members abutting each other.

2. The building wall or ceiling of claim 1 wherein the said abutted flanges of adjaent members are held by a panel clip comprising a generally U-shaped sheet metal shape having opposing legs and outwardly extending flanges at the end of each leg so that said legs hold flanges of adjacent members securely together by spring action and said outwardly extending flanges are adjacent the central panel portion of each adjacent building construction member.

3. A building wall having two faces, each of said faces comprising multiple juxtaposed construction members and panel clips as defined in claim 2, the abutted flanges of those members comprising one face of the wall being medially interspersed with the opposing panel and forming studs between the studs so formed by the adjacent flanges of the members of the opposite face, the wall of said panel clip joining opposing legs of the U-shaped clip having a resilient pad in touching bracing contact with the opposite panel providing accurate spacing and providing sound deadening to the wall.

4. The building wall of claim 3 additionally having carrier clips holding said building construction member snugly against a floor channel, said carrier clips comprising an inverted U-shaped portion to hold said clips snugly in position against a floor channel leg and an upstanding U-shaped portion to hold said building construction member snugly at the bottom.

5. The building wall of claim 3 having synthetic polymeric foam between said building construction members to insulate said wall.

6. The wall structure of claim 1 wherein carrier clips hold said building construction member snugly against a floor channel, said carrier clips comprising an inverted U-shaped portion to hold said clip snugly in position against a floor channel leg and an upstanding U-shaped portion to hold said building construction member snugly at the bottom.

7. The wall structure of claim 1 wherein a synthetic polymeric foam sheet fills the space between said flanges and the wall panel assembly comprising said construction member and said foam is mounted adjacent the interior of a masonry wall.

8. The building wall or ceiling of claim 1 having synthetic polymeric foam slabs having a slot for receiving said juxtaposed building construction member flanges, said foam slabs having a laminated layer forming the opposing wall surface to said building construction members.

9. The building wall or ceiling of claim 8 wherein said laminated layer comprises precast concrete panels.

10. A building wall having two faces, each of said faces comprising multiple juxtaposed construction members as defined in claim 1 in parallel array with flanges of adjacent members abutting each other, the abutted flanges of those members comprising one face of the wall being medially interspersed with the opposing panel, a synthetic polymeric foam sheet in the space between said flanges, said polymeric sheet having a slot for receiving said juxtaposed building construction member flanges of the opposed construction members, said construction member flange ends in touching bracing contact with the foam of said opposing construction member, thereby providing insulation and sound deadening.

11. The building wall or ceiling of claim 1 having two adjacent thicknesses of said construction members.

12. A beam or column cover and fireproofing assembly comprising two construction members as defined in claim 1 as side covers, adjacent end covering members of the same gypsum board construction having an additional V-groove and end flange at each end thereby forming C-shaped end covers, the opposing end flanges of said end covers abutting the end flanges of said side coverings.

13. A hollow column, column cover, soffit, duct or duct cover, comprising gypsum board which may be shipped to the job site in flat condition and formed at the job site, comprising a rectangular panel of gypsum board having face laminae and a core layer of gypsum therebetween, said board having on one face thereof one to three V-grooves set inwardly from the long edges for the full length of the gypsum board which penetrate the gypsum core substantially for the entire depth of said core leaving intact a sufficient thickness of the lamina of the face opposite the grooved face to act as a hinge, said grooves having adhesive means therein and forming a two, three or four sided structure when the gypsum board is hinged perpendicularly at said grooves and retained in that position by the adhesive means in said grooves.

14. A sloid construction post comprising a rectangular panel of gypsum board having face laminae and a core layer of gypsum therebetween said gypsum board having on one face thereof perpendicular V-grooves for the full length of the gypsum board set inwardly from the long edges thereof which penetrate the gypsum cores substantially for the entire depth of said core leaving intact a sufficient thickness of the lamina of the face opposite the grooved face to act as a hinge, said grooves having adhesive means therein and forming a solid post when the gypsum board is hinged perpendicularly at each of said grooves and retained in that position by adhesive means, thereby wrapping the gypsum board around itself forming a solid shape to the desired size.

* * * * *